US007780552B2

(12) United States Patent
Rhee

(10) Patent No.: US 7,780,552 B2
(45) Date of Patent: Aug. 24, 2010

(54) GOLF TEE

(76) Inventor: Jae-Woong Rhee, 1-1403 The O Superium, #832-5, Yeoksam 1-dong, Gangnam-gu, Seoul (KR)

( * ) Notice: Subject to any disclaimer, the term of this patent is extended or adjusted under 35 U.S.C. 154(b) by 0 days.

(21) Appl. No.: 12/247,018

(22) Filed: Oct. 7, 2008

(65) Prior Publication Data

US 2009/0275427 A1 Nov. 5, 2009

(30) Foreign Application Priority Data

Apr. 30, 2008 (KR) ..... 10-2008-0040714

(51) Int. Cl.
*A63B 57/00* (2006.01)

(52) U.S. Cl. ..... 473/396; 473/401

(58) Field of Classification Search ..... 473/387–403
See application file for complete search history.

(56) References Cited

U.S. PATENT DOCUMENTS

| | | | | | |
|---|---|---|---|---|---|
| 1,736,583 | A * | 11/1929 | Deike | 473/396 |
| 2,470,817 | A * | 5/1949 | Hendricks | 473/396 |
| 3,254,890 | A * | 6/1966 | Watson | 473/396 |
| 4,418,916 | A * | 12/1983 | Matsuura | 473/396 |
| 4,524,974 | A * | 6/1985 | Matsuura | 473/396 |
| 4,786,054 | A * | 11/1988 | Keys | 473/396 |
| 5,154,417 | A | 10/1992 | Kohli | |
| 5,242,170 | A | 9/1993 | Ward | |
| 5,375,838 | A | 12/1994 | Labriola et al. | |
| 5,505,444 | A | 4/1996 | Bouclin, Jr. | |
| 6,224,500 | B1 | 5/2001 | Mizohata | |
| 6,475,107 | B1 | 11/2002 | Sand | |
| 6,679,792 | B1 * | 1/2004 | Dorfman | 473/387 |
| 6,679,793 | B2 | 1/2004 | Joo | |
| 6,783,470 | B2 * | 8/2004 | Lee | 473/401 |
| 6,811,499 | B1 | 11/2004 | Hsien | |
| 6,960,143 | B2 | 11/2005 | Sato | |
| 7,008,335 | B2 | 3/2006 | Kim | |
| 7,011,586 | B2 | 3/2006 | Toyosawa et al. | |
| 7,494,429 | B2 * | 2/2009 | Lee | 473/396 |
| 2002/0022538 | A1 * | 2/2002 | Choi | 473/396 |
| 2006/0105861 | A1 * | 5/2006 | Yang | 473/396 |
| 2006/0229144 | A1 * | 10/2006 | Lee | 473/393 |
| 2007/0270245 | A1 * | 11/2007 | Jung | 473/396 |

FOREIGN PATENT DOCUMENTS

| | | |
|---|---|---|
| KR | 10-0730023 | 6/2007 |

* cited by examiner

*Primary Examiner*—Steven Wong
(74) *Attorney, Agent, or Firm*—Birch, Stewart, Kolasch & Birch, LLP

(57) ABSTRACT

A golf tee is able to decrease the number of parts, and an assembling process is simplified, and a manufacture and assembling work do not cost a lot, and an easier maintenance and a desired advertisement effect can be obtained. The golf tee comprises an upper body which has a spherical mounting surface formed on its upper surface for mounting a golf ball; a lower body which supports the upper body from a lower side with its lower end being sharp for an easier planting into a ground, with a rubber cord being installed so as to provide a certain tensional force so that the upper body is pulled all the time to be straight with respect to the lower body.

14 Claims, 9 Drawing Sheets

GOLF TEE

TECHNICAL FIELD

The present invention relates to a golf tee which supports a golf ball when a golf player strikes a ball for a golf game, and in particular to a golf tee which is capable of preventing damage by reducing an impact when a player strikes a golf ball with a driver and has a self-recovery function.

BACKGROUND ART

A golf game is a game in which a plurality of holes are made in a lawn field, and players strike balls using drivers or putt the same, and a winner or a loser is determined depending on who inputs the balls into the holes with the minimum strikes. The players start games in a tee ground in which a tee with a length of about 5 through 9 cm is planted on a ground, and a golf ball is placed on the planted tee. In this state, the player strikes the golf ball.

The golf tee is generally made of a wooden or a plastic material with its top being expanded in a conical concave shape for placing a golf ball thereon, with its lower end being sharpened for an easier installation on the ground.

The conventional golf tee is made in an integral body by using a wooden or a plastic material, namely, made of a rigid material. When a players swings and strikes the ball along with the golf tee, the shank of the golf tee receives a very strong impact force, so the golf ball is broken, which leads to a lot of consumption. From time to time, the golf tee might be pulled out from the ground by means of a very strong impact force and might fly a long distance, and it might be lost.

A flying direction of a golf ball is subject to a golf tee, and it is influenced by means of a resistance due to a friction between a golf ball and an upper surface of a golf tee when a golf ball is struck as well as a broken type and a flying direction of a broken golf tee. So, it is impossible to make a golf ball fly in a correct direction.

The Korean patent registration number 10-0730023 discloses a golf tee which is capable of preventing a golf tee from being broken due to an impact when a golf ball is stuck, and preventing a golf ball from being lost.

In the above patent, as shown in FIG. 8, an insertion pin 2 used for planting into the ground is separate from a body 1 of an upper side which supports a golf ball, and the upper and lower sides are connected using a connection pin 3, and a lower side of the connection pin 3 is inserted into an engaging groove 5 formed in an insertion pin 2, and an upper side of the connection pin 3 is elastically supported by means of a spring 7 and is movable in a space of the body 1. When the body 1 receives an impact force in a direction perpendicular to the shaft depending on a swing of the driver, the body 1 is bent in an impacting direction. At this time, the connection pin 3 made of a flexible plastic material is bent, and the lower end of the body 1 contacting with the insertion pin 2 is distanced depending on a compression of the spring 7, and the body 1 is disengaged from the insertion pin 2. Since the body 1 is bent with respect to the insertion pin 2 but is suspended to the insertion pin 2 with the help of the connection pin 3, it does not disengage but remains suspended. In this state, at the time when the driver strikes, the bent body 1 becomes upright by means of a recovery elastic force accumulated in the interior as the spring 7 is compressed, and is engaged with the insertion pin 2 in an upright state.

In the above patent, when an impact force is applied to the body 1, it does not pulled out from the ground along with the insertion pin 2, and only the body 1 is bent in a direction that the impact force is applied, and returns its original posture by means of a recovery force of the spring 7, which seems to be a bit improved as compared to the conventional art, but a lot of time is needed for assembling the system since an assembling structure is so complicated, and a manufacturing process of each element is complicated, and a lot of elements is needed. Manufacturing the above conventional golf tee costs a lot. In addition, productivity is very low.

As shown in FIG. 10, an auxiliary tee 18 is used for preventing the golf tees 1 and 2 from being lost. A certain cord 19 is additionally needed for fixing the auxiliary tee 18 to an insertion pin 2 of the golf tees 1 and 2, and a ring hole 15 should be formed in the insertion pin 2 for fixing the cord 19. A few processes are needed for forming the above elements. So the parts needed in the conventional golf tee cost a lot.

In addition, the golf needs a lot of time for finishing play, and the players play the game walking all days with the golf tees 1 and 2 in their bags or pockets. Although the golf tee is visually exposed to others for a long time, the golf tees are simply used as a disposable item, not for an advertisement item. When the connection pin 3 is disconnected or pulled out, it is impossible to repair the connection pin for thereby increasing over consumption.

DISCLOSURE OF THE INVENTION

Accordingly, it is an object of the present invention to provide a golf tee which overcomes the above-described problems.

It is another object of the present invention to provide a golf tee which needs a small number of elements, and an assembling structure is simple, and an assembling process does not cost a lot, and a repair or maintenance is easy, and the golf tee can be easily recycled.

It is further another object of the present invention to provide a golf tee which is capable of obtaining a certain advertisement effect.

To achieve the above objects, there is provided a golf tee which comprises an upper body which has a spherical mounting surface formed on its upper surface for mounting a golf ball; a lower body which supports the upper body from a lower side with its lower end being sharp for an easier planting into a ground; a hole which passes through the upper body in an axial direction; a shoulder support surface which has a diameter larger than the hole and is formed on the mounting surface of the upper side of the hole at a certain depth; a button shaped fixing member which includes a circular plate part for closely supporting the shoulder support surface, a protrusion part protruded from the circular plate part to the hole, and a rubber cord engaging hole which horizontally passes through the protrusion part; a rubber cord fixing hole which communicates with a lower side of the hole of the upper body and is formed from an upper surface of the lower body at a certain depth; and a rubber cord of which one end is fixedly inserted into the rubber cord engaging hole of the protrusion part, and the other end passes through the hole of the upper body and is fixed to the lower body through the hole of the rubber cord fixing hole, with the rubber cord being installed so as to provide a certain tensional force so that the upper body is pulled all the time to be straight with respect to the lower body.

According one feature of the present invention, the rubber cord fixing hole includes an opening which passes through a side surface of the lower body and is open to the outside, and the rubber cord is extended to the outside through the opening communicating with the rubber cord fixing hole and is knotted in a state that a tensional force is provided and is fixed to the lower body.

According to another feature of the present invention, a stopper cord made of a non-extendable material is loosely installed in parallel with the tensional rubber cord for thereby preventing the rubber cord from being extended by a certain length when the upper body is bent, and the rubber cord is extended.

According to another feature of the present invention, a sheet having a printed advertisement text or a photo is inserted into the hole while closely contacting with the inner wall surface of the hole, and the upper body is made of a transparent plastic material, so the sheet can be seen from the outside.

According to another feature of the present invention, a protection cap is covered on a lower end of the rubber cord for preventing the lower end being cut by means of a friction with the upper and lower bodies.

According to another feature of the present invention, the rubber cord is extended through an opening formed in a side surface of the rubber cord fixing hole of the lower body and is further extended by a certain length in a knotted state, and an auxiliary tee or an advertisement text label or an ID indication label are selectively attached on an end of the extended part for preventing the lost of the upper and lower bodies.

According to another feature of the present invention, the upper body integrally includes a mounting surface part having a mounting surface, and a button shaped fixing member, and a hollow pipe part having a hole is formed in a separate structure, and the mounting surface part is engaged on an upper side of the hollow pipe part by means of a tensional force of the rubber cord.

According to another feature of the present invention, a connection portion of the upper and lower bodies is formed in a gear shaped protrusion engaging structure.

According to another feature of the present invention, either upper body or lower body has a gear shaped protrusion engaging part which is formed in multiple stages, and the stages can be adjusted depending on the adjustment of the gear engaging position.

Effects

In the present invention, since the upper and lower bodies of the golf tee are connected by a rubber cord for providing an extensional force for absorbing an impact force, the construction of a golf tee is very simple, and the number of elements is small, and an assembling time and manufacturing cost can be significantly decreased. Even when a rubber cord is cut, a repair work is very easy, which leads to saving money. Since no specific elements are provided in the holes of the upper and lower bodies, a certain advertisement paper can be inputted into the same for obtaining an advertisement effect since an advertisement exposure time is long depending the characteristics of the golf play.

In addition, an attaching structure of an accessory such as an auxiliary golf tee or something is simple, and an additional cost is not needed.

BRIEF DESCRIPTION OF THE DRAWINGS

The present invention will become better understood with reference to the accompanying drawings which are given only by way of illustration and thus are not limitative of the present invention, wherein.

MODES FOR CARRYING OUT THE INVENTION

Figure 1:
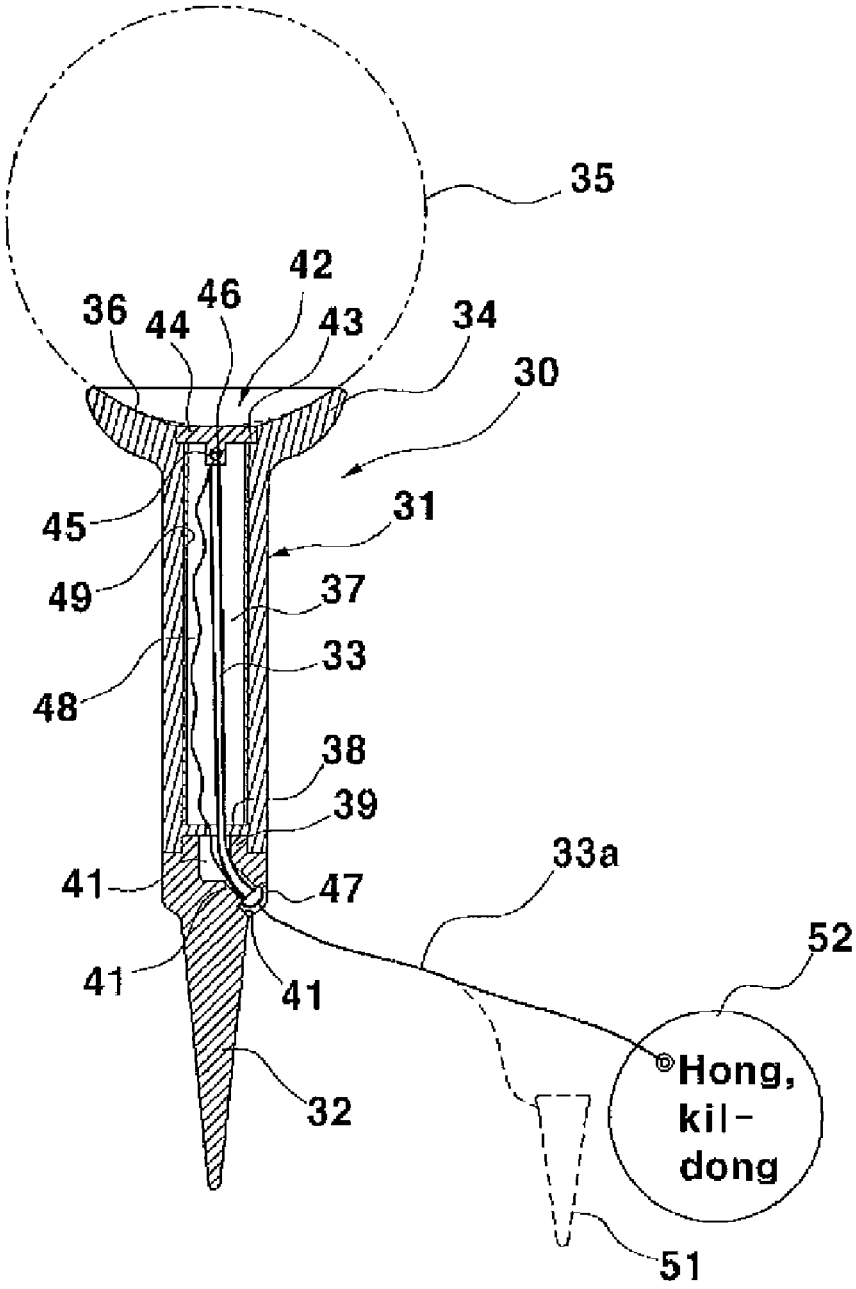
FIG. 1 is a front cross sectional view illustrating a golf tee according to an embodiment of the present invention.
Figure 2:
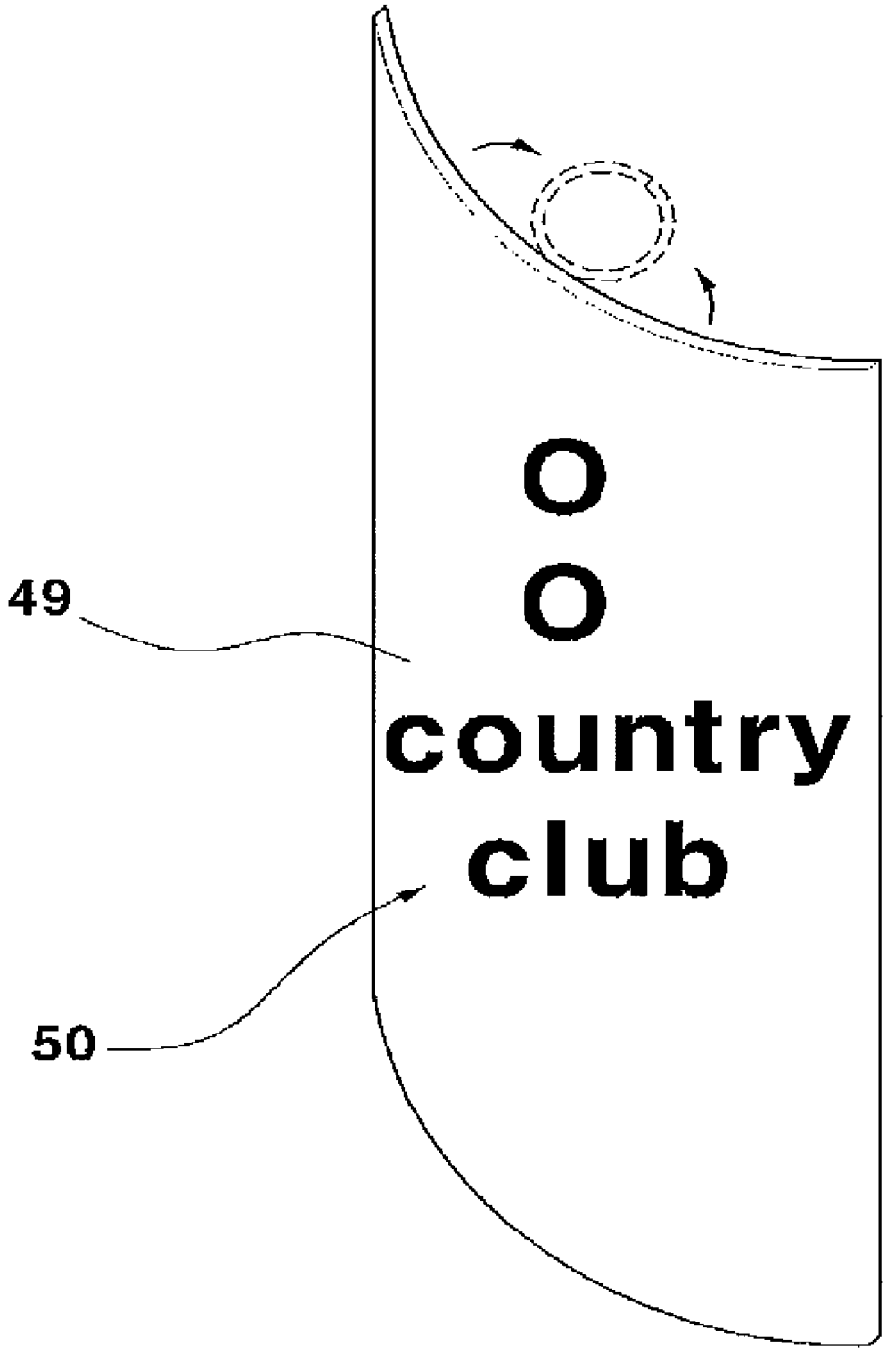
FIG. 2 is a view illustrating an example of an advertisement sheet according to the present invention.

The present invention will be described with reference to the accompanying drawings.

As shown in the drawings, the golf tee 30 according to the present invention comprises an upper body 31, a lower body 32 which supports the upper body 31, and a rubber cord 33 which connects the upper and lower bodies 31 and 32.

The upper body 31 is equipped with a conical mounting part 34 on its upper side, and a spherical concave mounting surface 36 shaped similarly with a curved surface of the golf ball 35 is formed on an upper surface of the mounting part 34 for mounting the golf ball 35 thereon.

The upper body 31 is formed in a hollow shape with a hole 37 being formed in the middle of the upper body while passing through the same along its central axis. A lower shoulder 38 is formed in its lower side for tightening the hole 37 at a certain distance from the end. A protrusion part 39 of the upper side of the lower body 32 is inserted into the lower shoulder 38.

The lower body 32 is formed in a shape with its lower end being sharpened in a lower direction, so the lower body 32 can be easily planted into the ground. A rubber cord fixing hole 41 is formed in the lower body 32 from an upper surface of the lower body 32 at a certain depth and communicates with the hole 37. The rubber cord fixing hole 41 is used for fixedly inserting a screw (not shown) fixed by one end of the rubber cord 33 into the hole. The rubber cord fixing hole 41 might be equipped with an opening which is open to the outside through the wall of the rubber cord fixing hole 41, so the rubber cord is extended to the outside of the lower body trough the opening of the rubber cord fixing hole 41 and is knotted and fixed.

A button shaped fixing member 42 is engaged on an upper side of the hole 37 of the upper body 31. A shoulder support surface 43 having a relatively larger diameter than the hole 37 is formed in the mounting hole 36 at a certain depth, and the button shaped fixing member 42 is inserted into the shoulder support surface 43.

The button shaped fixing member 42 comprises a circular plate 44, a protrusion part 45 which is protruded from a lower side of the circular plate 44 and is positioned in the hole 37, and a rubber cord engaging hole 46 which horizontally passes through the protrusion part 45.

One end of the rubber cord 33 is fixedly inserted into the rubber cord engaging hole 46 is knotted, and a U-shaped knotted end is extended into the hole 37 in a lower direction, and its lower end is knotted to a screw, and the screw is inserted into the rubber cord fixing hole 41 of the lower body 32. The lower end of the rubber cord 33 is extended to one side through the opening of the rubber cord fixing hole 41 which passes through a wall surface of the lower body 32 and then is knotted. The tied knot part 47 is supported by means of the opening of the rubber cord fixing hole 41 and is not disengaged from the same. When the upper and lower bodies 31 and 32 are connected by means of the rubber cord 33, a screw is engaged in a state that a tensional force is provided by pulling the rubber cord 33 or the knot 47 is formed, so the upper body 31 keeps being pulled toward the lower body 32. The upper and lower bodies 31 and 32 remain engaged in normal time. The rubber cord 33 is preferably made of an elastic string or cord by covering an outer circumference of the rubber cord with a woven fabric of special high tenacity yarn.

In addition, a stopper cord 48 made of an inelastic, non-flexible material and longer than the rubber cord 33, and is woven with a fishing line having a relatively strong tensional strength.

The stopper cord 48 has a certain length long enough to prevent the upper body 31 from being bent at a certain angle so as to prevent the rubber cord 33 from being cut as the rubber cord 33 receives a tensional force when the upper body 31 is bent with respect to the lower body 32.

The button shaped fixing member 42 is formed of a circular plate having a protrusion part 45. One or more rubber cord engaging holes are formed while passing through the circular plate, and the rubber cord 33 is inserted into the engaging hole. One end of the engaged rubber cord 33 is knotted or it is inserted in an upside down U-shape, and its end is knotted on a lower surface of the circular plate. The other end is extended to a lower side for fixing or it is inserted into two engaging holes in an upside down U-shape, and both ends are gathered and extended downward and fixed. Any changes of the above construction are equivalent to the present invention.

A thin sheet 49 is rolled in a circular shape and is inserted into an inner wall surface of the hole 37. A certain advertisement text 50 indicating a golf club name or something is formed on the sheet 49 or an owner's photo might be printed. A transparent material plastic is used for molding the upper body 31, 50 the printed contents of the sheet 49 is viewed through the upper body 31.

The rubber cord 33 fixed to the lower body 32 has an extension part 33*a* extended from the knot part 47. In this case, an auxiliary tee 51 might be handed at an end of the extension part 33*a* for preventing the golf tee 30 from flying away, which the golf tee is used by hanging on the side 40 of the golf tee 30.

Figure 3:
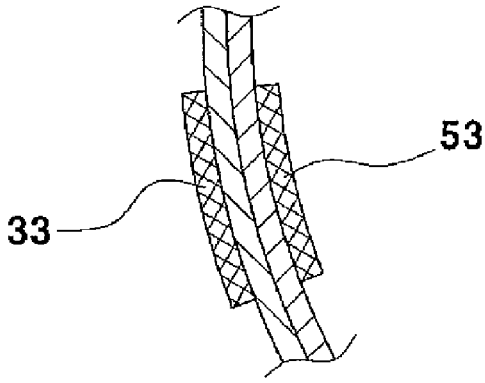
FIG. 3 is a view illustrating a protection cap for protecting a rubber cord according to the present invention

As shown in FIG. 3, a protection cap 53 is covered on a lower end of the rubber cord 33 for preventing the rubber cord 33 from being cut as it has a friction with the lower side of the upper body 31.

Figure 4:
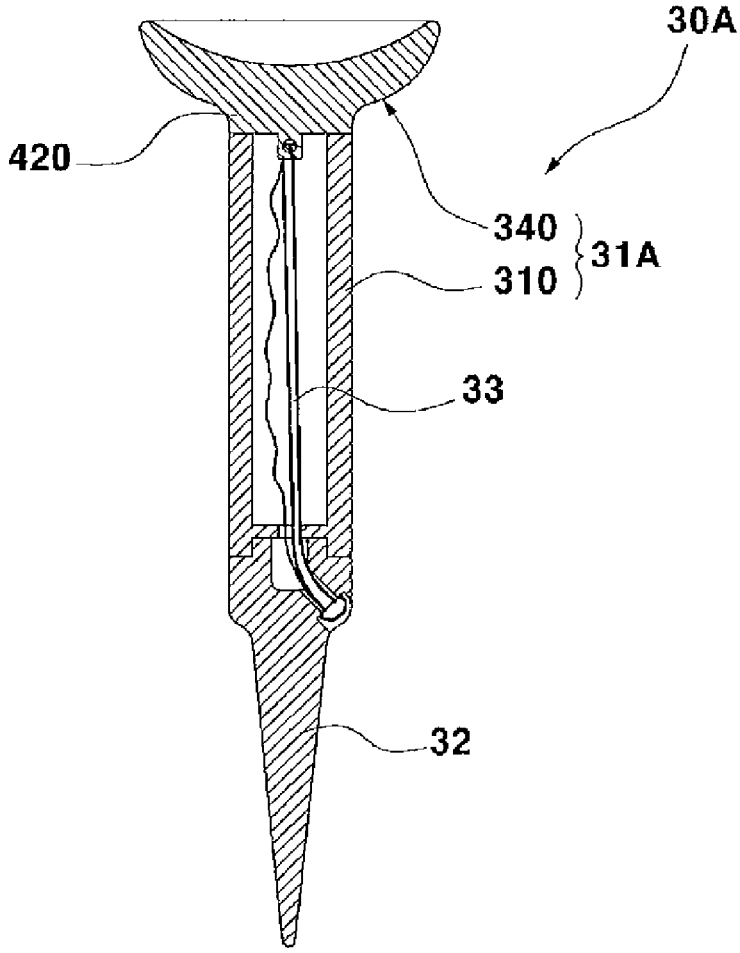
FIG. 4 is a front cross sectional view illustrating a modified embodiment of the present invention.

FIG. 4 is a view of a modified embodiment of the present invention. In case of the embodiment of FIG. 1, two parts 31 and 32 are provided, but in this embodiment, three parts 310, 32 and 340 are provided.

In the golf tee 30A of the embodiment of FIG. 4, the lower body 32 is same, but the upper body 31A is divided into two parts of a mounting surface part 340 and a hollow pipe part 310. The button shaped fixing member 420 is formed in an integral structure with the mounting surface part 340, so the tensional force of the rubber cord 33 allows the mounting surface part 340 to keep engaged at the upper side of the hollow pipe part 310. So, when the golf ball 35 mounted on the mounting surface part 341 receives an impacting force, the applied impact force can be effectively absorbed with the helps of a two-stage bending depending on the degree of the impact.

Figure 5:
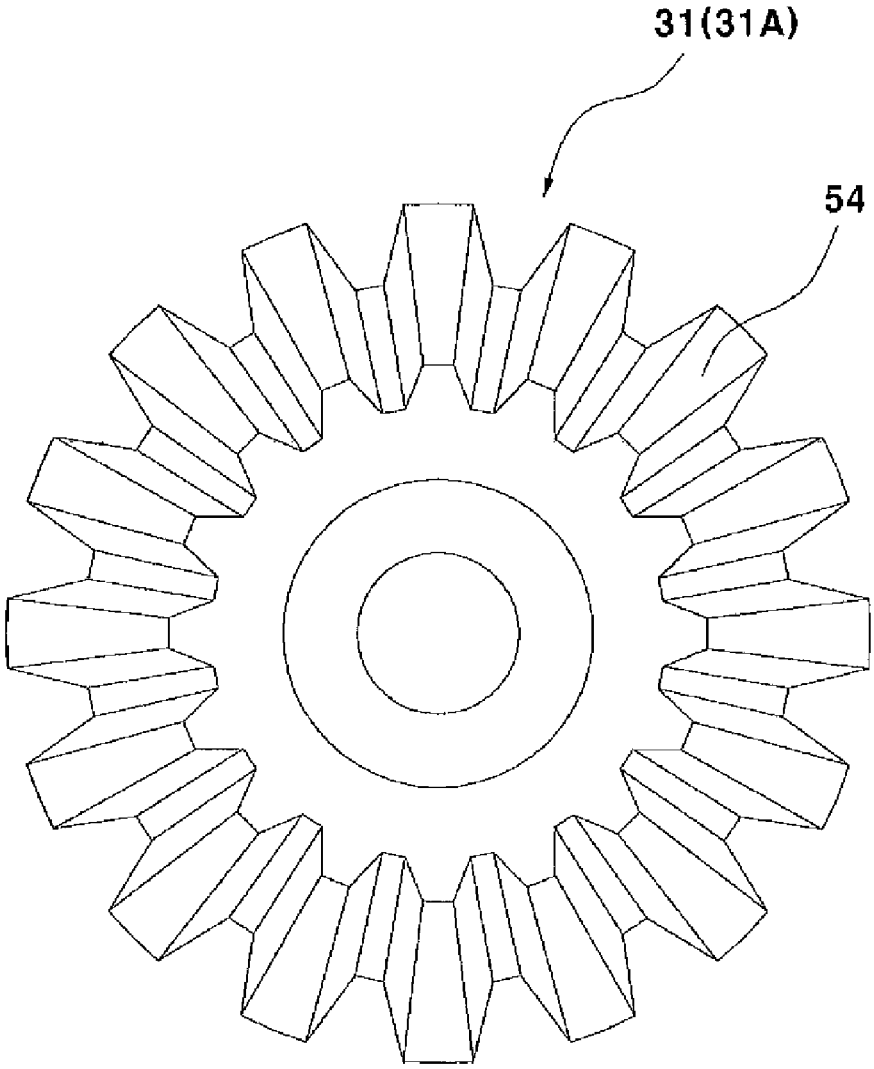
FIG. 5 is a bottom view illustrating an upper body for describing a gear shaped engaging structure of the upper and lower bodies according to the present invention.
Figure 6:
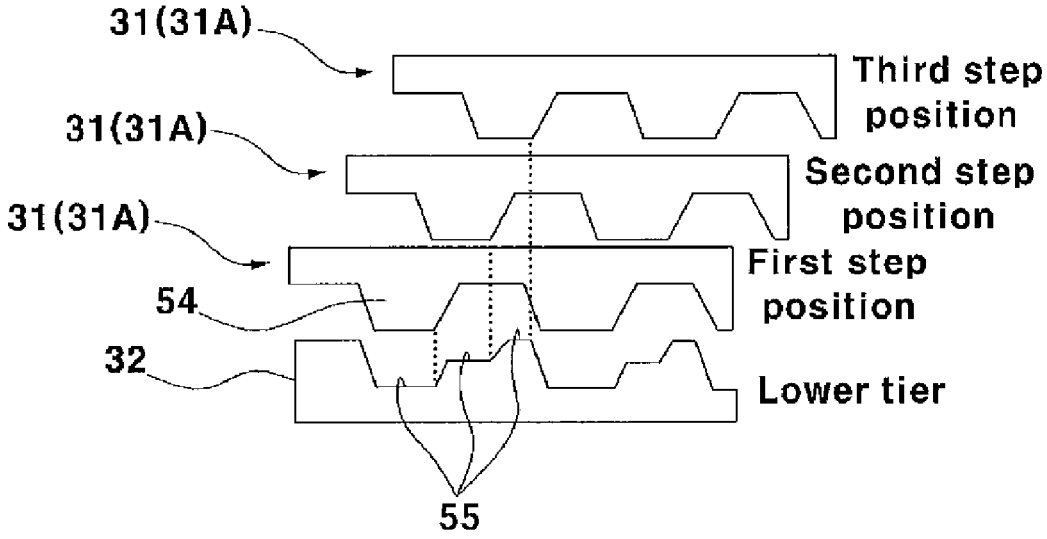
FIG. 6 is a view illustrating a gear shaped engaging structure of the upper and lower bodies according to the present invention while describing a state that the height can be adjusted with the help of a multiple-stage structure.

As shown in FIGS. 5 and 6, the connection portions of the upper bodies 31 and 31A and the lower body 32 are formed in gear shaped protrusion engaging structures 54 and 55 which are engaged with each other. So, it is possible to easily plant into a hard surface of the ground while rotating left and right. For example, the gear shaped protrusion engaging part 55 of the lower body 32 might be formed in a multi-stage shape, so the upper bodies 31 and 31A are gradually rotated and engaged. As shown in FIG. 6, it is possible to adjust the height of the upper body from one stage to three stages. Please refer to FIGS. 5 and 6.

Figure 7:
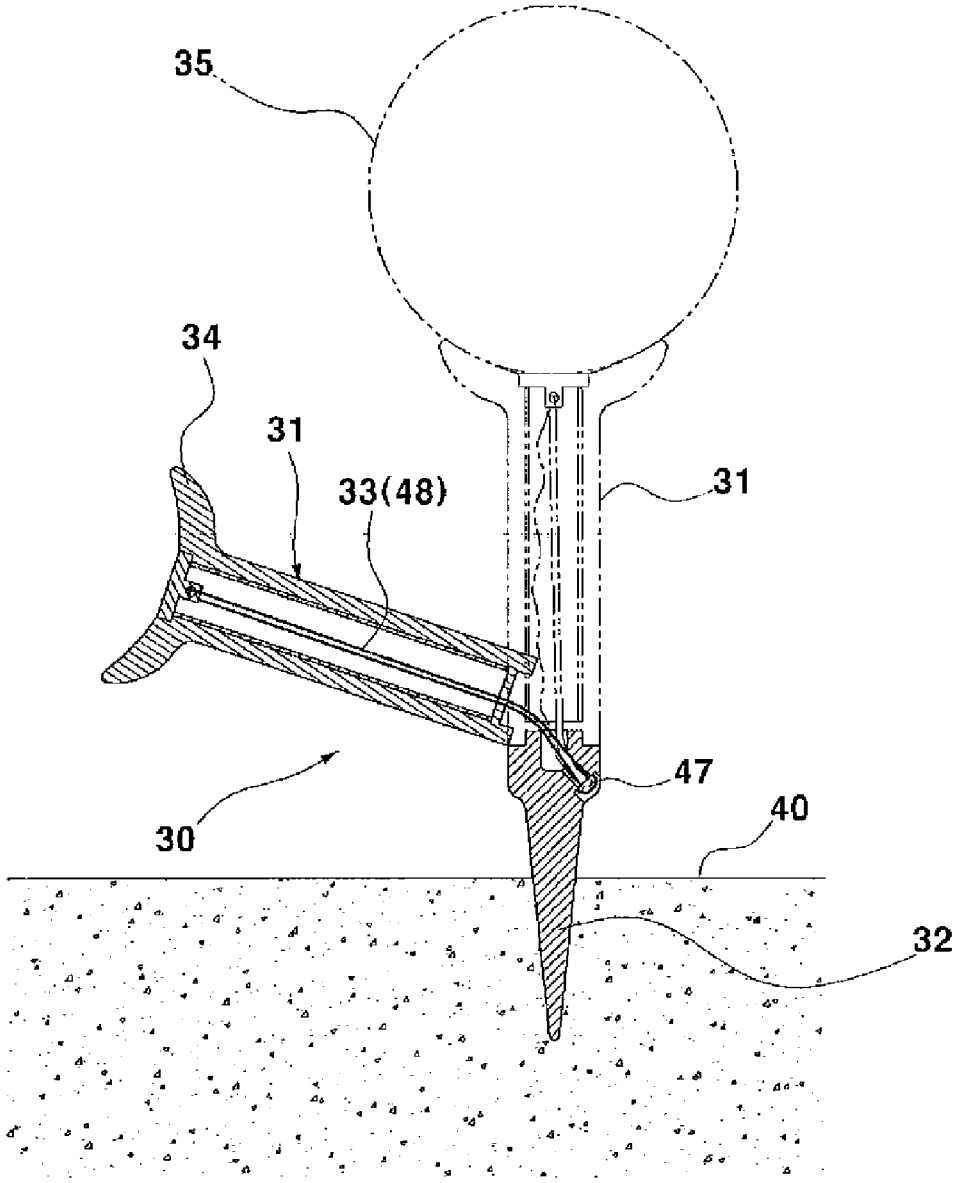
FIG. 7 is a view illustrating a state that an upper body is bent by means of an impacting force when using a golf tee according to the present invention while describing the maximum vent state in which a rubber cord is extended up to the length of a stopper cord.
Figure 8:
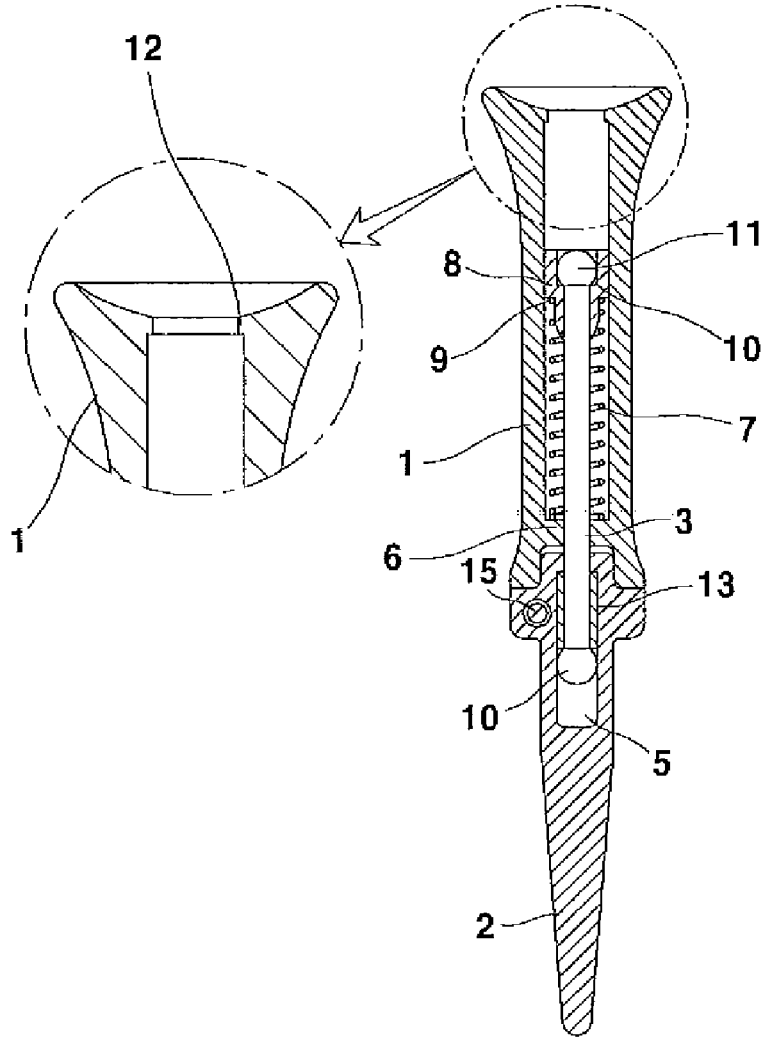
Fig. 8 PRIOR ART
FIGS. 8 through 10 are views illustrating conventional golf tees.
Figure 9:
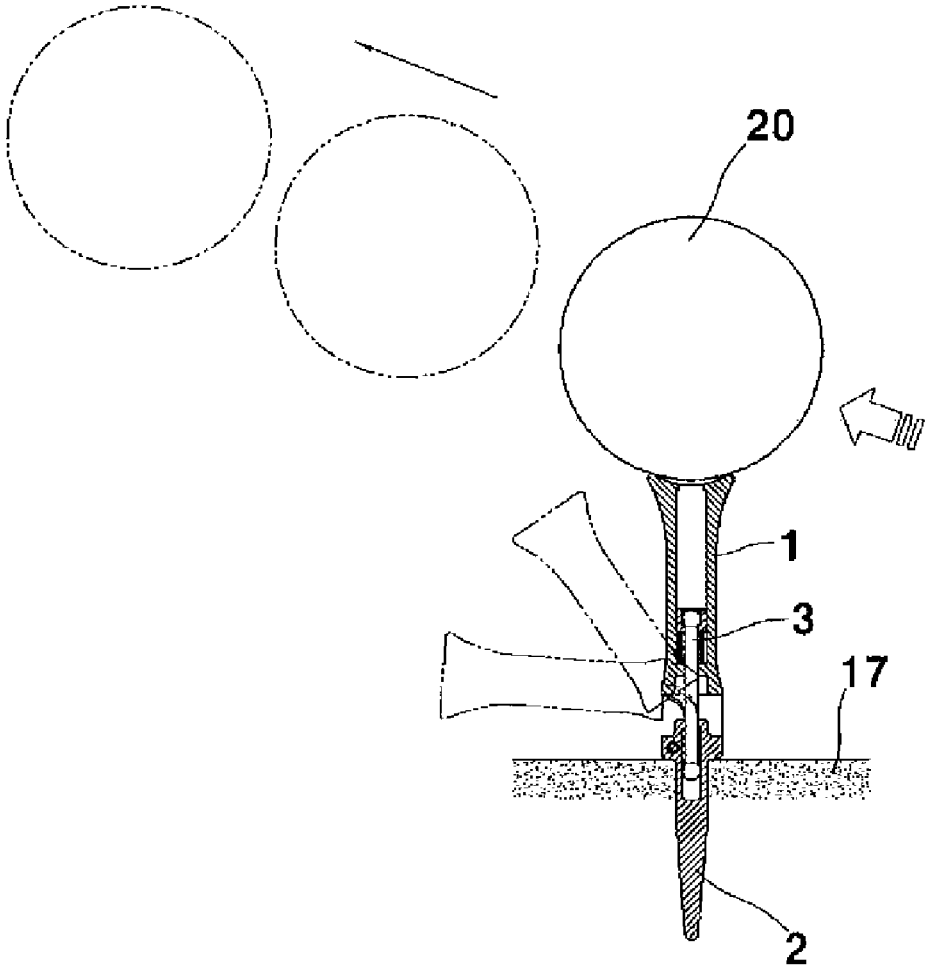
Fig. 9 PRIOR ART
Figure 10:
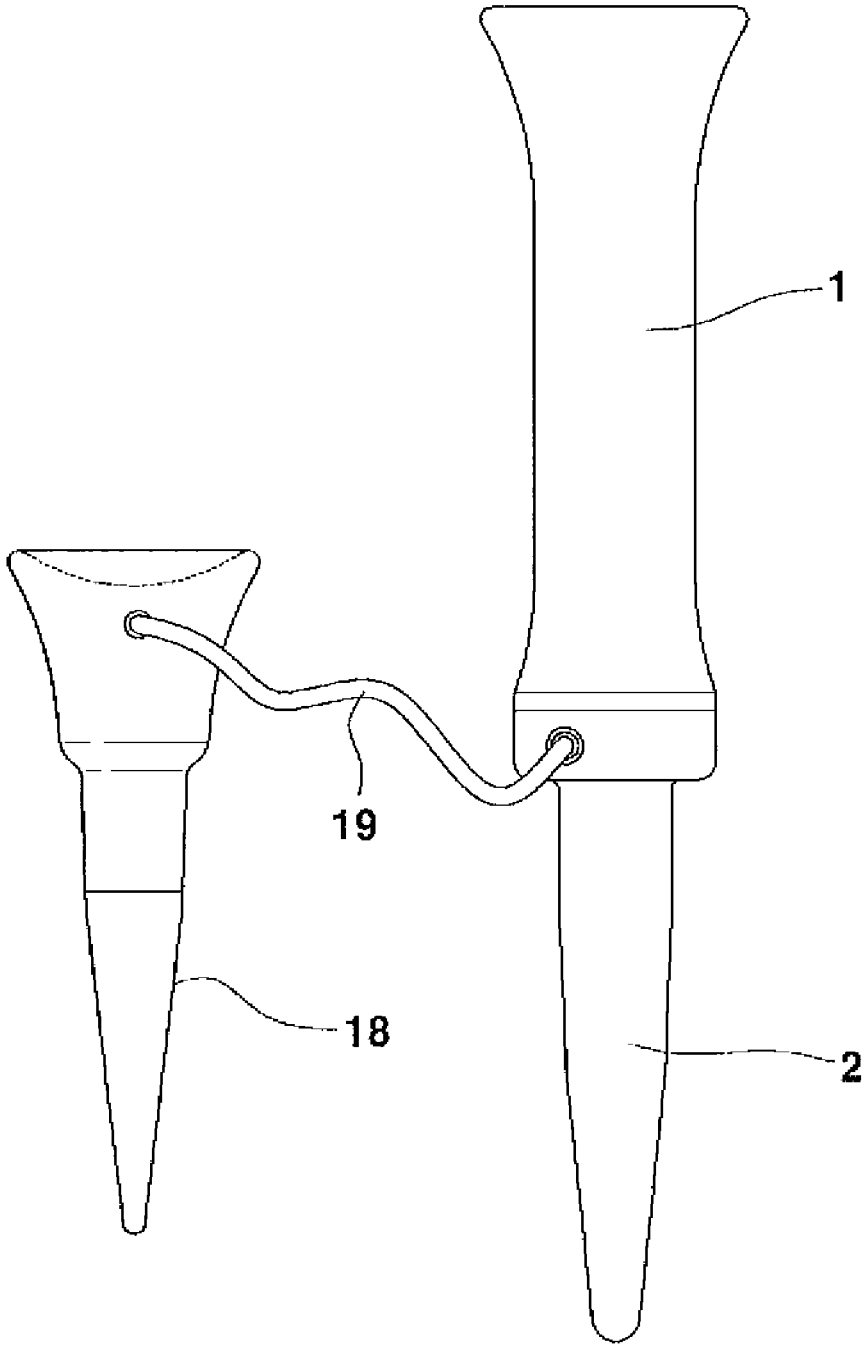
Fig. 10 PRIOR ART

As shown in FIG. 7, when the golfer strikes the golf ball 35 to a destination in a forward direction, the upper body 31 is bent from an upright posture (indicated by doted lines) to a bent posture (indicated by a solid line in a direction that an impact force is applied. At this time, the rubber cord 33, which receives a tensional force, is elongated for thereby allowing the upper body 31 to bent. The bent upper body 31 returns to its original shape by means of a pulling operation with the help of the tensional force of the elongated rubber cord 33, and is engaged with the lower body 32 of FIG. 1 and becomes an upright shape.

Although it is not shown in the drawings, in another embodiment of the present invention, the upper body 31 and the lower body 32 might be engaged in a spherical engaging structure by using a ball construction, not in a protrusion engaging structure.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A golf tee, comprising:

an upper body which has a spherical mounting surface formed on its upper surface for mounting a golf ball;

a lower body which supports the upper body from a lower side with its lower end being sharp for an easier planting into a ground;

a hole which passes through the upper body in an axial direction;

a shoulder support surface which has a diameter larger than the hole and is formed on the mounting surface of the upper side of the hole at a certain depth;

a button shaped fixing member which includes a circular plate part supported by the shoulder support surface, a protrusion part protruded from the circular plate part to the hole, and a rubber cord engaging hole which horizontally passes through the protrusion part;

a rubber cord fixing hole which communicates with a lower side of the hole of the upper body and is formed from an upper surface of the lower body at a certain depth; and a rubber cord of which one end is fixedly inserted into the rubber cord engaging hole of the protrusion part, and the other end passes through the hole of the upper body and is fixed to the lower body through the hole of the rubber cord fixing hole, with the rubber cord being installed so as to provide a certain tensional force so that the upper body is pulled all the time to be straight with respect to the lower body, wherein a stopper cord made of a non-extendable material loosely installed in parallel with the tensional rubber cord for thereby preventing the rubber cord from being extended by a certain length when the upper body is bent, and the rubber cord is extended.

2. The golf tee of claim 1, wherein said rubber cord fixing hole includes an opening which passes through a side surface of the lower body and is open to the outside, and said rubber cord is extended to the outside through the opening communicating with the rubber cord fixing hole and is knotted in a state that a tensional force is provided and is fixed to the lower body.

3. The golf tee of claim 1, wherein a sheet having a printed advertisement text or a photo is inserted into the hole while closely contacting with the inner wall surface of the hole, and said upper body is made of a transparent plastic material, so the sheet can be seen from the outside.

4. The golf tee of claim 1, wherein a protection cap is covered on a lower end of the rubber cord for preventing the lower end from being cut by means of a friction with the upper and lower bodies.

5. The golf tee of claim 2, wherein said rubber cord is extended through an opening formed in a side surface of the rubber cord fixing hole of the lower body and is further extended by a certain length, and an auxiliary tee or an advertisement text label or an ID indication label are selectively attached on an end of the extended part.

6. The golf tee of claim 1, wherein said upper body integrally includes a mounting surface part having a mounting surface, and a button shaped fixing member, and a hollow pipe part having a hole is formed in a separate structure, and the mounting surface part is engaged on an upper side of the hollow pipe part by means of a tensional force of the rubber cord.

7. The golf tee of claim 1, wherein a connection portion of the upper and lower bodies is formed in a gear shaped protrusion engaging structure.

8. The golf tee of claim 7, wherein either upper body or lower body has a gear shaped protrusion engaging part which is formed in multiple stages, and the stages can be adjusted depending on the adjustment of the gear engaging position.

9. The golf tee of claim 2, wherein a sheet having a printed advertisement text or a photo is inserted into the hole while closely contacting with the inner wall surface of the hole, and said upper body is made of a transparent plastic material, so the sheet can be seen from the outside.

10. The golf tee of claim 2, wherein a protection cap is covered on a lower end of the rubber cord for preventing the lower end from being cut by means of a friction with the upper and lower bodies.

11. The golf tee of claim 2, wherein said upper body integrally includes a mounting surface part having a mounting surface, and a button shaped fixing member, and a hollow pipe part having a hole is formed in a separate structure, and the mounting surface part is engaged on an upper side of the hollow pipe part by means of a tensional force of the rubber cord.

12. The golf tee of claim 2, wherein a connection portion of the upper and lower bodies is formed in a gear shaped protrusion engaging structure.

13. The golf tee of claim 5, wherein a connection portion of the upper and lower bodies is formed in a gear shaped protrusion engaging structure.

14. The golf tee of claim 1, wherein said rubber cord has a woven fabric covering its outer circumference.

* * * * *